US010640242B2

(12) United States Patent
Stajkovic et al.

(10) Patent No.: US 10,640,242 B2
(45) Date of Patent: May 5, 2020

(54) SEALING MEMBER COMPRISING A PACKAGE VOLUME CONTROLLING SECTION

(71) Applicant: TETRA LAVAL HOLDINGS & FINANCE S.A., Pully (CH)

(72) Inventors: Marko Stajkovic, Malmö (SE); Håkan Andersson, Åkarp (SE); Louis Carlioz, Arlöv (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 16/497,622

(22) PCT Filed: Mar. 26, 2018

(86) PCT No.: PCT/EP2018/057664
§ 371 (c)(1),
(2) Date: Sep. 25, 2019

(87) PCT Pub. No.: WO2018/178024
PCT Pub. Date: Oct. 4, 2018

(65) Prior Publication Data

US 2020/0017246 A1 Jan. 16, 2020

(30) Foreign Application Priority Data

Mar. 28, 2017 (EP) ..... 17163340

(51) Int. Cl.
*B32B 37/00* (2006.01)
*B65B 9/20* (2012.01)
(Continued)

(52) U.S. Cl.
CPC ..... *B65B 9/2049* (2013.01); *B65B 9/12* (2013.01); *B65B 51/14* (2013.01); *B65B 51/227* (2013.01);
(Continued)

(58) Field of Classification Search
USPC ..... 156/580
See application file for complete search history.

(56) References Cited

U.S. PATENT DOCUMENTS 5,220,771 A 6/1993 Burns
6,725,634 B1 * 4/2004 Palmqvist ..... B29C 65/3656 53/548
(Continued)

FOREIGN PATENT DOCUMENTS

DE 10111841 A1 9/2002
EP 1509453 A1 3/2005
(Continued)

OTHER PUBLICATIONS

Extended European Search Report for European Patent Application No. 17163340.7, dated Sep. 20, 2017.
(Continued)

*Primary Examiner* — James D Sells
(74) *Attorney, Agent, or Firm* — Knobbe, Martens, Olson & Bear, LLP

(57) ABSTRACT

A sealing member comprising a sealing section configured to interact with a sealing band of a tube of packaging material in a sealing stage, and a package volume controlling section configured to interact with a first area next to the sealing band of said tube of packaging material in the sealing stage, wherein said package volume controlling section is provided with a socket for holding an insert.

7 Claims, 5 Drawing Sheets

(51) Int. Cl.

| | |
|---|---|
| ***B65B 9/12*** | (2006.01) |
| ***B65B 51/14*** | (2006.01) |
| ***B65B 61/06*** | (2006.01) |
| ***B65B 55/10*** | (2006.01) |
| ***B65B 59/04*** | (2006.01) |
| ***B65B 51/22*** | (2006.01) |

(52) U.S. Cl.
CPC ..... *B65B 55/103* (2013.01); *B65B 59/04* (2013.01); *B65B 61/06* (2013.01)

(56) References Cited

U.S. PATENT DOCUMENTS

| | | | |
|---|---|---|---|
| 2005/0172574 | A1 | 8/2005 | Paradisi et al. |
| 2010/0186349 | A1 | 7/2010 | Zanini et al. |
| 2011/0120059 | A1 | 5/2011 | Andreotti et al. |
| 2016/0067937 | A1 | 3/2016 | Yeager et al. |

FOREIGN PATENT DOCUMENTS

| | | | |
|---|---|---|---|
| EP | 2151390 | A1 | 2/2010 |
| WO | WO 2012/019925 | A1 | 2/2012 |
| WO | WO 2012/103592 | A1 | 8/2012 |

OTHER PUBLICATIONS

International Search Report and Written Opinion for International Application No. PCT/EP2018/057664, dated May 5, 2018, in 12 pages.

* cited by examiner

SEALING MEMBER COMPRISING A PACKAGE VOLUME CONTROLLING SECTION

CROSS-REFERENCE TO RELATED APPLICATIONS

This application is the U.S. National Phase under 35 U.S.C. § 371 of International Application PCT/EP2018/057664, filed Mar. 26, 2018, which claims priority to EP Application No. 17163340.7, filed Mar. 28, 2017, the entire contents of each of which are incorporated by reference herein and made a part of this specification.

TECHNICAL FIELD

The invention relates to packaging technology, for instance roll-fed carton packaging systems for liquid food. More particularly, it is presented a sealing member comprising a package volume controlling section, an insert to be placed in a socket in the package volume controlling section, a sealing apparatus comprising the sealing member, and a method for customizing a sealing apparatus.

BACKGROUND ART

Today in the field of roll fed carton packaging systems for liquid food products, e.g. Tetra Brik™ systems sold and marketed by Tetra Pak™, it is known to use a sealing apparatus provided with convex portions in order to control a volume of product in a lower part of a tube of packaging material during a transversal sealing stage. In this way it is possible to assure that a package being formed contains a volume according to set requirements.

The convex portions can be provided at different places of the sealing apparatus, such as the sealing members. More particularly, the convex portions of the sealing members can be placed on sections of the sealing members placed next to sealing surfaces of the sealing members. By having convex portions placed in this way, the convex portions will during the sealing stage provide for that a top panel and a bottom panel, respectively, of the package being formed are pushed inwards, towards a mid-portion of the tube, and thereby a more controlled forming of the package can be achieved.

The general principle as well as an example of how convex portions can be used in roll-fed carton packaging systems are presented in EP 1 509 453 by the applicant, Tetra Laval Holdings & Finance S.A.

The prior art successfully achieves to present a packaging system that is reducing a problem of having packages produced with an inconsistent volume content. However, having the convex portions set correctly may be a cumbersome and lengthy process. There are a number of factors to take into account, such as product properties and packaging material properties, and if the packaging system is used for a variety of different products and types of packaging material the process may be needed to be repeated often.

SUMMARY

It is an object of the invention to at least partly overcome one or more of the above-identified limitations of the prior art. In particular, it is an object to provide a sealing apparatus with package volume controlling properties that can be easily adapted.

According to a first aspect it is provided a sealing member comprising a sealing section configured to interact with a sealing band of a tube of packaging material in a sealing stage, and a package volume controlling section configured to interact with a first area next to the sealing band of said tube of packaging material in the sealing stage, wherein said package volume controlling section is provided with a socket for holding an insert.

The socket may be provided with socket protrusions for holding the insert in place.

The socket protrusions may extend in a sliding direction perpendicular to a surface normal of said package volume controlling section.

The socket may be arranged for receiving the insert via a section placed opposite to the sealing section.

The sealing member may further comprise a tube controlling section configured to interact with a second area next to the sealing band, wherein the first area and the second area are placed on each sides of the sealing band in the sealing stage, wherein the tube controlling section is provided with an additional socket for holding an additional insert.

The sealing member may further comprise an inductor.

According to a second aspect it is provided an insert comprising a convex portion configured to interact with the first area of a tube of packaging material in a sealing stage, wherein the insert is configured to be held in a socket of a sealing member according to the first aspect.

The insert may be provided with insert protrusions configured to interact with socket protrusions of the socket.

The insert may be configured to be held in the socket of the package volume controlling section.

The insert may further comprise a first section configured to be placed in the socket, and a second section placed on top of the first section and the second section may be placed offset the first section.

According to a third aspect it is provided a sealing apparatus comprising a first sealing member and a second sealing member, wherein the first sealing member and the second sealing member both comprising a package volume controlling section provided with a socket holding an insert according to the second aspect.

The first sealing member may be provided with an inductor and an active surface of the sealing section, and the second sealing member may be provided with at least one pressure pad for providing a counter-pressure in a sealing stage.

According to a fourth aspect it is provided a method for customizing a sealing device, said method comprising placing an insert provided with a convex portion in a socket of a sealing member of the sealing apparatus, wherein the socket is provided in a package volume controlling section of the sealing member.

The insert may be placed in the socket by sliding the insert into the socket.

The method may further comprise placing an additional insert in an additional socket of the sealing member, wherein the additional socket is provided in a tube controlling section of the sealing member.

BRIEF DESCRIPTION OF THE DRAWINGS

Embodiments of the invention will now be described, by way of example, with reference to the accompanying schematic drawings, in which.

DETAILED DESCRIPTION

Figure 1:
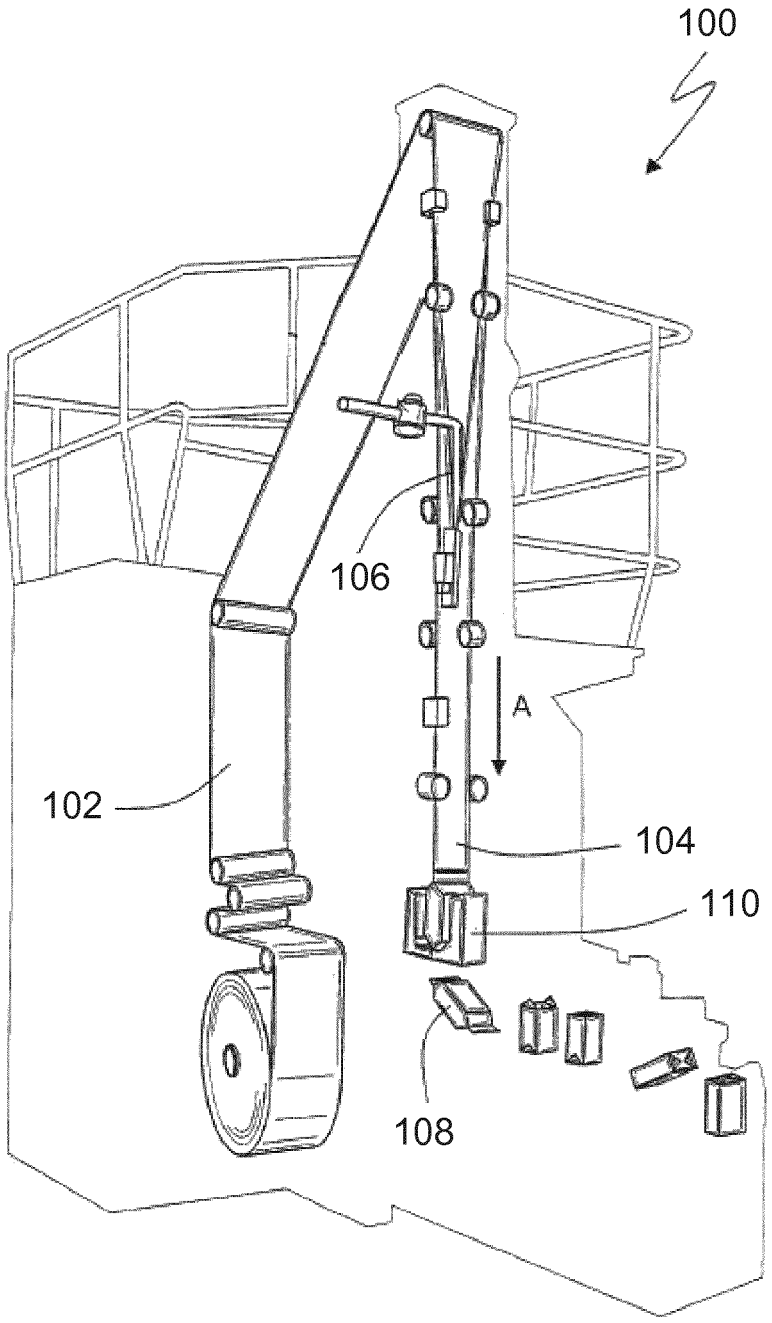
FIG. 1 is a general illustration of a roll-fed carton packaging machine.

FIG. 1 generally illustrates a packaging machine 100. In the illustrated example, the packaging machine 100 is a roll fed carton packaging machine. The general principle of such a machine is that from a roll of packaging material a web 102 is formed. Although not illustrated, if needed in order to fulfill food safety regulations, the web 102 may be sterilized using a hydrogen peroxide bath, a Low Voltage Electron Beam (LVEB) device or any other apparatus capable of reducing a number of unwanted microorganisms. After sterilization, by using a longitudinal sealing apparatus, the web 102 can be formed into a tube 104. When having formed the tube a product, for instance milk, can be fed into the tube 104 via a product pipe 106 placed at least partly inside the tube 104.

In order to form a package 108 from the tube 104 filled with product, a transversal sealing can be made in a lower end of the tube by using a sealing apparatus 110. Generally, the sealing apparatus 110 has two main functions—providing the transversal sealing, i.e. welding two opposite sides of the tube together such that the product in a lower part of the tube, placed downward the sealing apparatus, is separated from the product in the tube placed upward the sealing apparatus, and cutting off the lower part of the tube such that the package 108 is formed. Alternatively, instead of providing the transversal sealing and cutting off the lower part in one and the same apparatus as illustrated, the step of cutting off the lower part may be made in a subsequent step by a different piece of equipment, or by the consumer if the packages are intended to be sold in a multi-pack.

Figure 2:
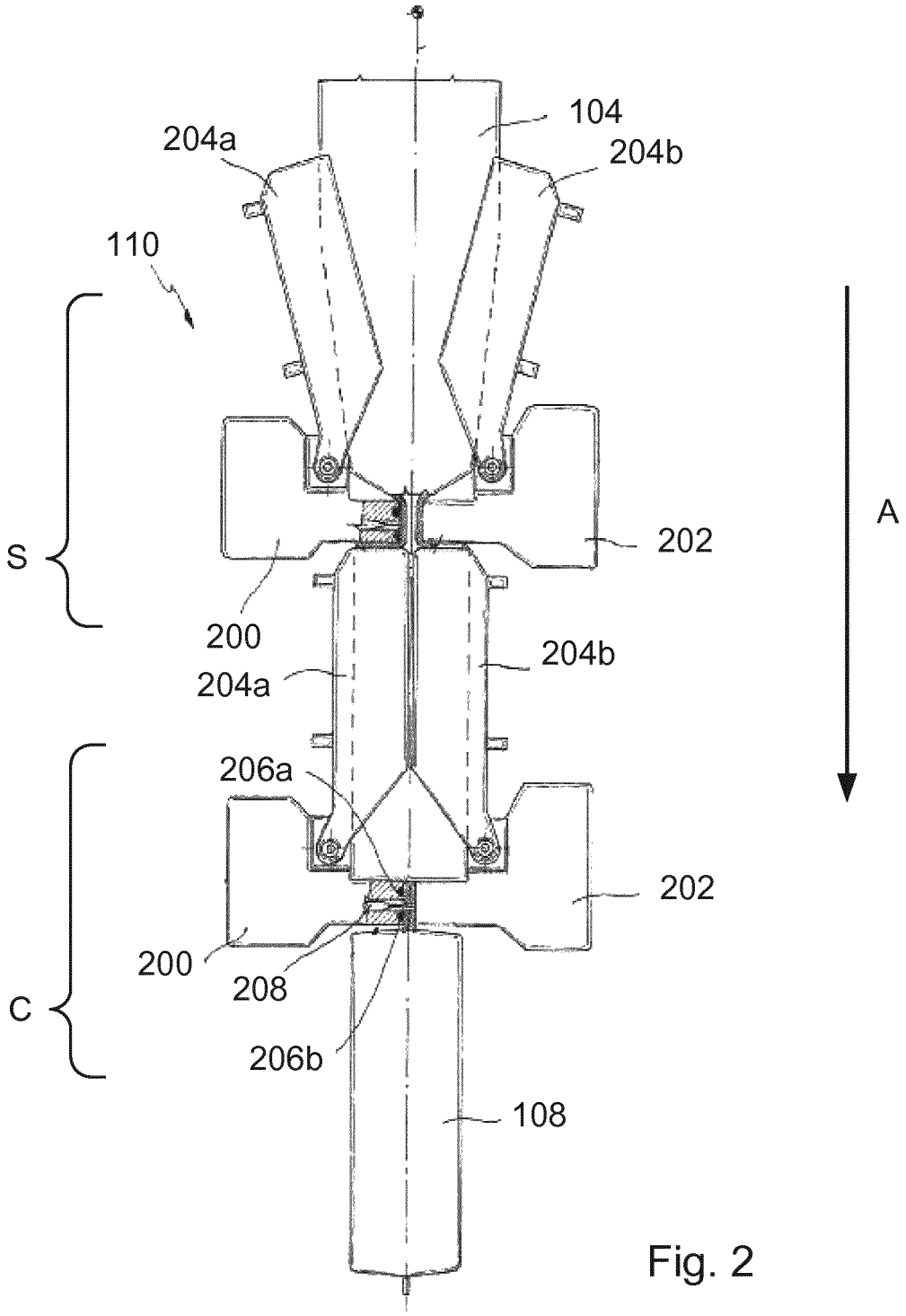
FIG. 2 is a cross-sectional view of a sealing system of the packaging machine of FIG. 1.

In FIG. 2 a general principle of the sealing apparatus 110 is illustrated in further detail. The tube 104 can be fed from above since this provides for that product can be held inside the tube. In a first stage, a sealing stage S, a first jaw provided with an induction heat sealing device 200 and a second jaw provided with a counter pressure device 202 are moved towards each other such that two opposite sides of the tube 104 are pressed towards one another. In order to provide for the transversal sealing, heat can be provided by inducing eddy currents in the packaging material while pressing the two opposite sides together. The heat provides for that a plastic layer of the packaging material is melted, which in turn provides for the plastic layer can be used for making sure that the two opposite sides can attach to each other and stay together after the jaws are removed. In a subsequent step, herein referred to as a cutting stage C, the lower part of the tube 104 can be cut off such that the package 108 is formed. In order to increase a speed in which packages are formed, the jaws can be moved together with the tube 104 in a tube feeding direction A during the sealing stage S and the cutting stage C.

In order to provide for a more controlled forming process of the package 108 so-called volume forming flaps 204*a*, 204*b* can be used. More specifically, by using these the tube 104 having a round cross-section may be steered into a package 108 having a rectangular cross-section in a controlled manner.

The sealing device can be provided with two inductors, a first inductor 206*a* and a second inductor 206*b*. In the illustrated example, the first inductor 206*a* is arranged above the second inductor 206*b*. After having provided the transversal sealing a knife 208 can be used for cutting off the lower part of the tube and thus form the package 108. In this example, the knife 208 and the first and second inductors 206*a*, 206*b* are provided in the sealing device, but other arrangements are also possible. For instance, the knife may be provided on the other side of the tube, in the counter pressure device, or the cutting step may be performed by a separate device downstream the sealing device.

The induction heat sealing device 200, or other sealing device used for providing power such that plastic layers in the packaging material melts, and the counter pressure device 202, or other device for providing a counter pressure, may generally be referred to as sealing members.

Figure 3A:
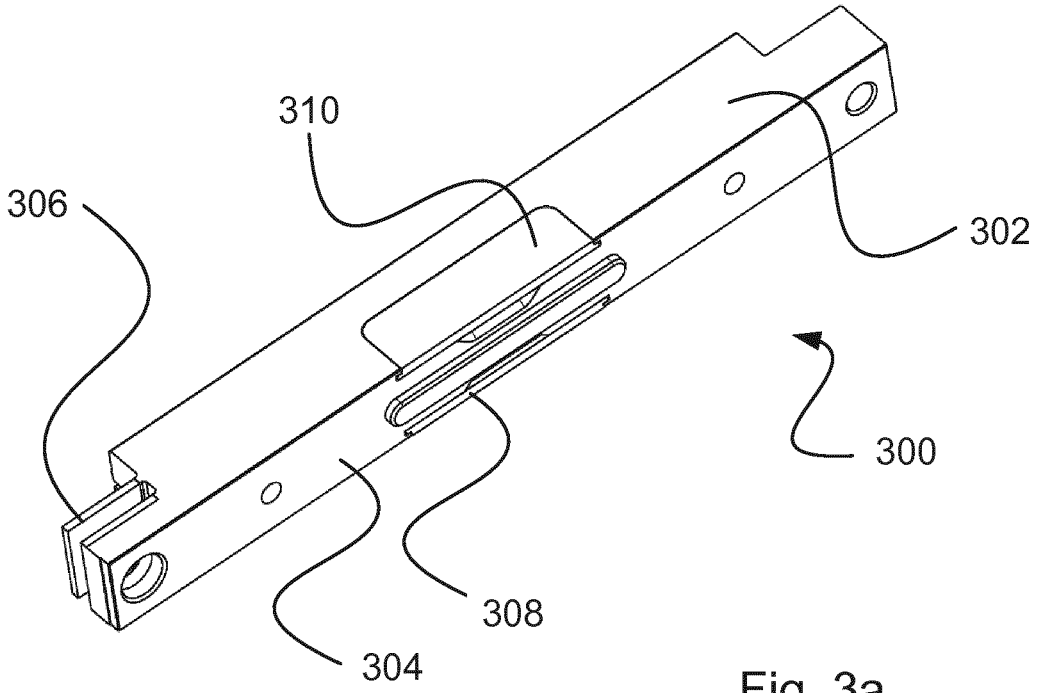
FIGS. 3*a*, 3*b* and 3*c* illustrates a sealing member provided with slots for holding inserts.
Figure 3B:
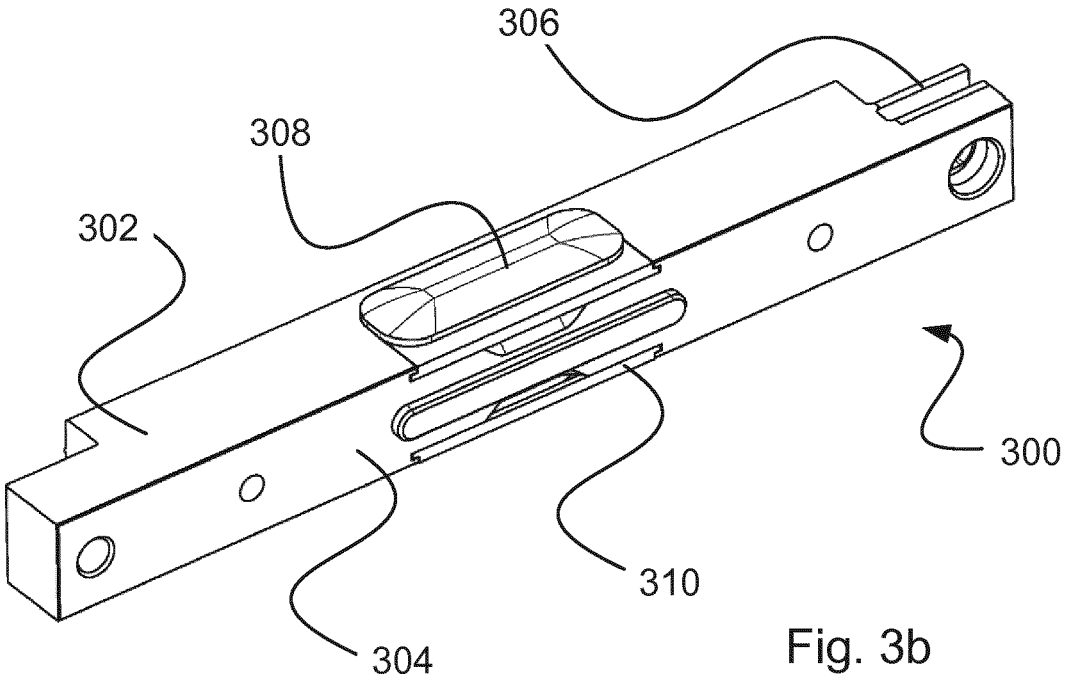
Figure 3C:
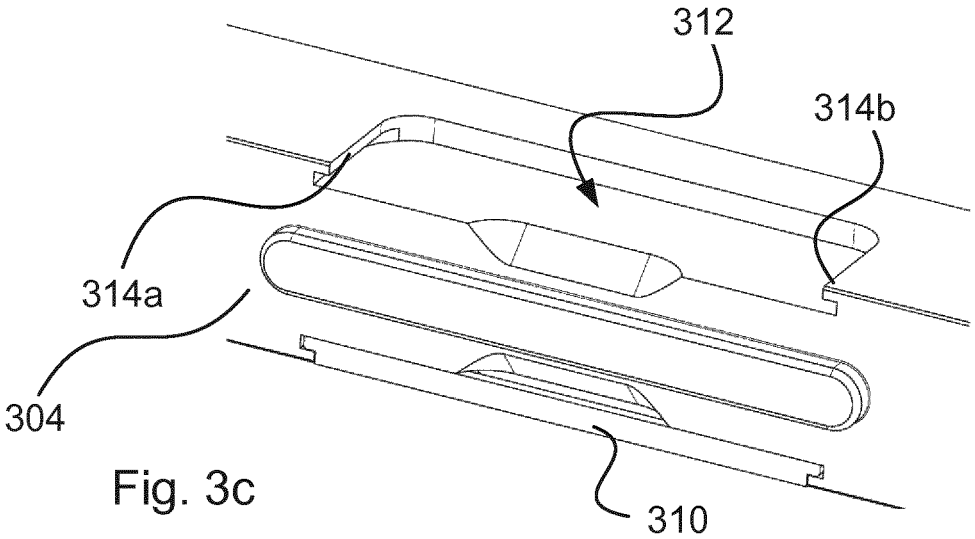

FIGS. 3*a*, 3*b* and 3*c* illustrate a sealing member 300 similar to the sealing device 200 illustrated in FIG. 2. The sealing member 300 may comprise a main body 302, which may comprise a section 304 placed opposite to the sealing section. In the main body an inductor may be provided. The inductor may, as explained above, be used for inducing eddy currents in the packaging material during the sealing stage S. The inductor may be fed with electrical power via a connector 306.

In order to provide for that areas next to a sealing area, also referred to as sealing band, of the tube of packaging material are held in placed during the sealing stage S a first insert 308 and a second insert 310 may be used. In FIG. 3*a* the sealing member 300 is illustrated with the first insert 308 provided with a convex portion facing downwards and in FIG. 3*b* the sealing member is turned upside down with the first insert 308 facing upwards. A section of the sealing member in which the first insert 308 is placed in FIG. 3*a* may be referred to as a package volume controlling section, and the opposite side in which the second insert 310 is placed may be referred to as a tube controlling section.

By having the first insert 308 facing downwards, as illustrated in FIG. 3*a*, an area of the tube beneath the sealing area will be pressed inwards, which will result in that the volume of a package being formed can be controlled with increased accuracy. Put differently, if the package is produced with a bottom section facing upwards and a top section facing downwards, a bottom panel of the package being formed may be pressed inwards by the convex portion of the first insert 308.

The inserts 308, 310 may be provided with or without the convex portion. A reason for this is that the sealing member 300 may be symmetrical such that it can be mounted in the sealing apparatus 110 with the connector 306 facing in two opposite directions. This is advantageous for at least two reasons. First, one and the same member may be used for both mounting alternatives, which provides efficient supply chain. Secondly, by mounting a number of sealing members with every second of them facing in the same direction more room is provided for service technicians.

By having the inserts 308, 310 provided both with or without the convex portion, the sealing member 300 can easily be adapted such that irrespective of how it is mounted the convex portion may be facing downwards.

Even though not illustrated, inserts with different types of convex portions may be provided. For instance, a particular type of packaging material may have properties making a particular design of the convex portion more beneficial than others. In the same way the product in the tube may have an effect on how the convex portion is to be designed. Thus, by having the convex portion coupled to an easily exchangeable insert the possibility of customizing the sealing member for a particular product and/or a particular packaging material is made practically viable.

As illustrated in FIG. 3*c*, a socket 312 provided with socket protrusions 314*a*, 314*b* may be used for holding the insert 308, 310 in place. The inserts 308, 310 may be slided into position and after being slided into position and the sealing member is attached to the sealing jaw with the sealing section facing the sealing jaw the inserts are restricted from sliding out of position.

Figure 4:
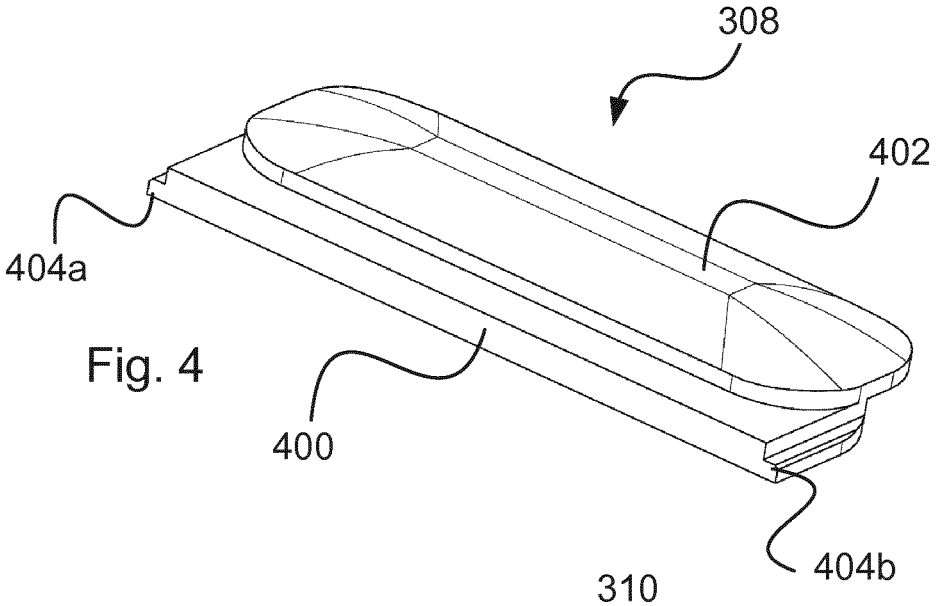
FIG. 4 illustrates a first insert with a convex portion.

The first insert 308 is illustrated in further detail in FIG. 4. The first insert 308 can comprise a first section 400 arranged to be slided into the socket 312 of the sealing member and a second section 402 comprising the convex portion. The first section 400 and the second section 402 may be offset in relation to one another. An advantage of this is that the socket 312 can be kept small without compromising on placement of the convex portion. Since the main body 302 of the sealing member 300 may comprise an inductor and other devices related to this, possible negative effects of having an extensive socket may be avoided.

The first insert 308 may be provided with insert protrusions 404*a*, 404*b* arranged to cooperate with the socket protrusions 314*a*, 314*b*. An advantage of sliding the insert in place instead of having it screw mounted is that the latter is requiring holes in the main body 302. These holes affect the electromagnetic profile negatively, and therefore avoiding making holes for fastening the insert is beneficial for the functionality of the sealing apparatus. Further, drilling holes in the main body 302 is negatively affecting the durability of the sealing member.

Figure 5:
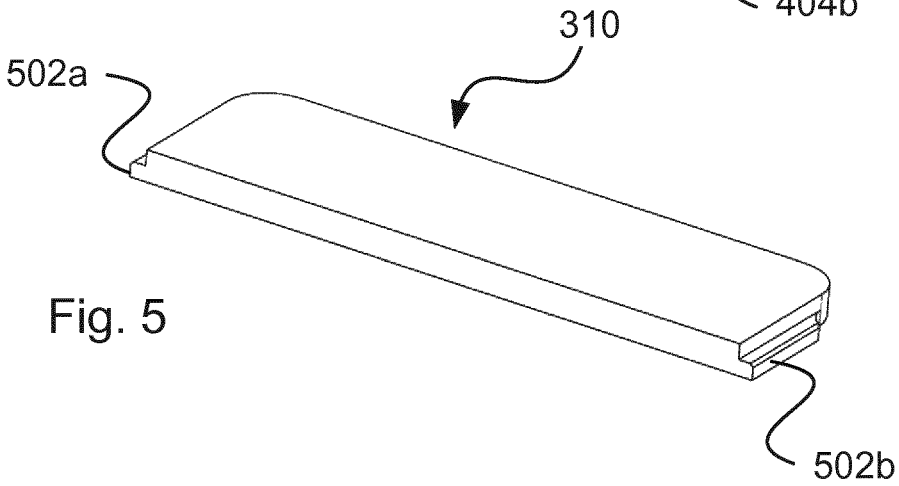
FIG. 5 illustrates a second insert without a convex portion.

In addition, a positive effect of having the insert slided into position from the section 304 facing the sealing jaw is that the insert may easily be removed from the sealing member. The sealing member may be attached to the sealing jaw by screws. Thus, as an effect, only a screw driver is required for replacing the insert. In FIG. 5, the second insert 310 is illustrated in further detail. In a similar manner as the first insert 308, the second insert 310 may be provided with insert protrusions 502*a*, 502*b* arranged to cooperate with the socket protrusions 314*a*, 314*b*. Unlike the first insert 308, the second insert 310 is not provided with a convex portion, but is serving as a placeholder.

Even though it is illustrated to have one insert provided with convex portion facing downward and another insert without convex portion facing upward, it is possible to have inserts with convex portions facing downward and upward if found beneficial for a particular packaging material and/or product.

Figure 6:
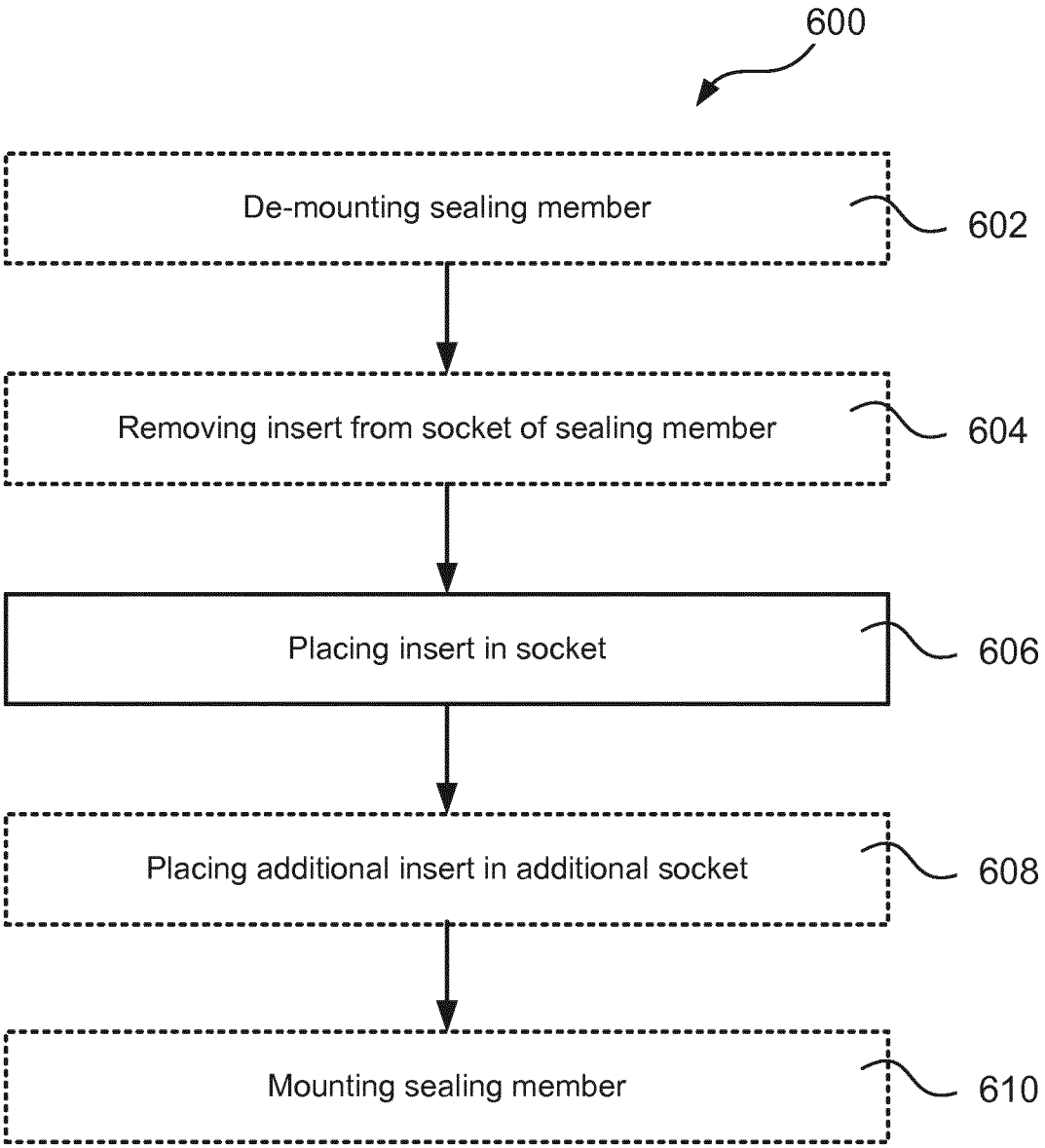
FIG. 6 presents a flowchart illustrating steps of a method for customizing a sealing apparatus.

In order to adapt or customize the sealing device a method illustrated in the flowchart 600 of FIG. 6 may be followed.

In step 602 the sealing member can be de-mounted from the sealing apparatus. After having de-mounted, the insert placed in the socket may be removed in step 604. When having the socket free, another insert may be placed in the socket in the package volume controlling section in step 606. Optionally, an additional insert may be placed in an additional socket placed in the tube controlling section in step 608. Finally, the sealing member may be mounted back into the sealing apparatus in step 610.

From the description above follows that, although various embodiments of the invention have been described and shown, the invention is not restricted thereto, but may also be embodied in other ways within the scope of the subject-matter defined in the following claims.

What is claimed is:

1. A sealing member comprising:

a sealing section configured to interact with a sealing band of a tube of packaging material in a sealing stage, and a package volume controlling section configured to interact with a first area next to the sealing band of said tube of packaging material in the sealing stage, wherein said package volume controlling section is provided with a socket for holding an insert, wherein the socket is provided with socket protrusions for holding the insert in place, wherein the socket protrusions extend in a sliding direction perpendicular to a surface normal of said package volume controlling section, and wherein the socket is arranged for receiving the insert via a section placed opposite to the sealing section.

2. The sealing member according to claim 1, further comprising a tube controlling section configured to interact with a second area next to the sealing band, wherein the first area and the second area are placed on each sides of the sealing band in the sealing stage, wherein the tube controlling section is provided with an additional socket for holding an additional insert.

3. The sealing member according to claim 1, wherein the sealing member further comprises an inductor.

4. An insert comprising:

a convex portion configured to interact with the first area of a tube of packaging material in a sealing stage, a first section configured to be placed in the socket, and a second section placed on top of the first section and placed off set the first section wherein the insert is configured to be held in a socket of a sealing member according to claim 1.

5. The insert according to claim 4, wherein the insert is provided with insert protrusions configured to interact with socket protrusions of the socket.

6. The insert according to claim 4, wherein the insert is configured to be held in the socket of the package volume controlling section.

7. A sealing apparatus comprising a first sealing member and a second sealing member, wherein the first sealing member is provided with an inductor and an active surface of the sealing section, and the second sealing member is provided with at least one pressure pad for providing a counter-pressure in the [VI] sealing stage, and wherein the first sealing member and the second sealing member both comprising a package volume controlling section provided with a socket holding an insert according to claim 4.

* * * * *